US005123654A

United States Patent [19]

Liu

[11] Patent Number: 5,123,654

[45] Date of Patent: Jun. 23, 1992

[54] BALL-DELIVERING-AND-CATCHING DEVICE

[75] Inventor: Li-Wei Liu, Taipei, Taiwan

[73] Assignee: Lucky Star Enterprise Co., Ltd., Taipei, Taiwan

[21] Appl. No.: 792,408

[22] Filed: Nov. 15, 1991

[51] Int. Cl.[5] ..... A63B 67/00

[52] U.S. Cl. ..... 273/322; 273/402

[58] Field of Search ..... 273/322-326, 273/328, 396, 398-402; D21/201, 199, 200, 210, 221, 2, 5

[56] References Cited

U.S. PATENT DOCUMENTS

D. 307,040 4/1990 Helalian ..... D21/201 X 1,022,186 4/1912 Engler ..... 273/322

3,392,978 7/1968 Wiest, Jr. ..... 273/322

*Primary Examiner*—Paul E. Shapiro

*Attorney, Agent, or Firm*—Bacon & Thomas

[57] ABSTRACT

A ball-delivering-and-catching device the structure of which allows a ball or the like to roll back and forth thereon and then fly into the air moving along a parabolic path before falling down into or outside a catching hoop if a user grips a handle of the device and adequately sways the device forward and backward. Catching hoops with different shapes showing desired ball games may be used along with matching ball of achieve more fun. Furthermore, different pictures or cards showing different ball games may be selectively inserted into grooves formed on a backboard of the device to enhance the excitement.

3 Claims, 6 Drawing Sheets

BALL-DELIVERING-AND-CATCHING DEVICE

BACKGROUND OF THE INVENTION

The present invention relates to a ball delivering-and catching device with which a user may catch a ball delivered by the same device by holding a handle portion of the device and applying force upward to roll a ball thereon through a curvy portion of the device so that the ball moves along a parabolic path and falls into a basket on the device.

Presently, a ball-bouncing-out-and-back means is commercially available. A ball or the like is tied with a elastic string to a striking means, the ball bounces out when it is striken by the striking means and bounces back toward the player due to the pull by the elastic string. With this means, an individual player alone may continuously strike the ball back and forth while enjoying the exercise excitingly. Usually, a player needs larger space and even specific place suitable to play with such means. Therefore, it is tried by the applicant to develop a ball-delivering-and-catching device which may be readily and conveniently used by a player at any time and any place to get a lot of funs.

SUMMARY OF THE INVENTION

It is a primary object of the present invention to provide a ball-delivering-and-catching device which has an upward curvy front portion allowing a ball thereon to roll through and move along a parabolic path before caught by a catching means. With this device, a player requires small space and energy to enjoy much fun at any time and become skilled with games provided by this device.

A second object of the present invention is to provide a device as mentioned above, in which changes may be made to the shape of the catching means and the ball according to the prefered ball games of the player to acheive more funs.

A further object of the present invention is to provide a device as mentioned above, in which a backboard may be provided behind the catching means and different pictures or cards showing different ball games may be inset into the backboard to give more funs.

DETAILED DESCRIPTION OF THE PREFERRED EMBODIMENTS

Figure 1:
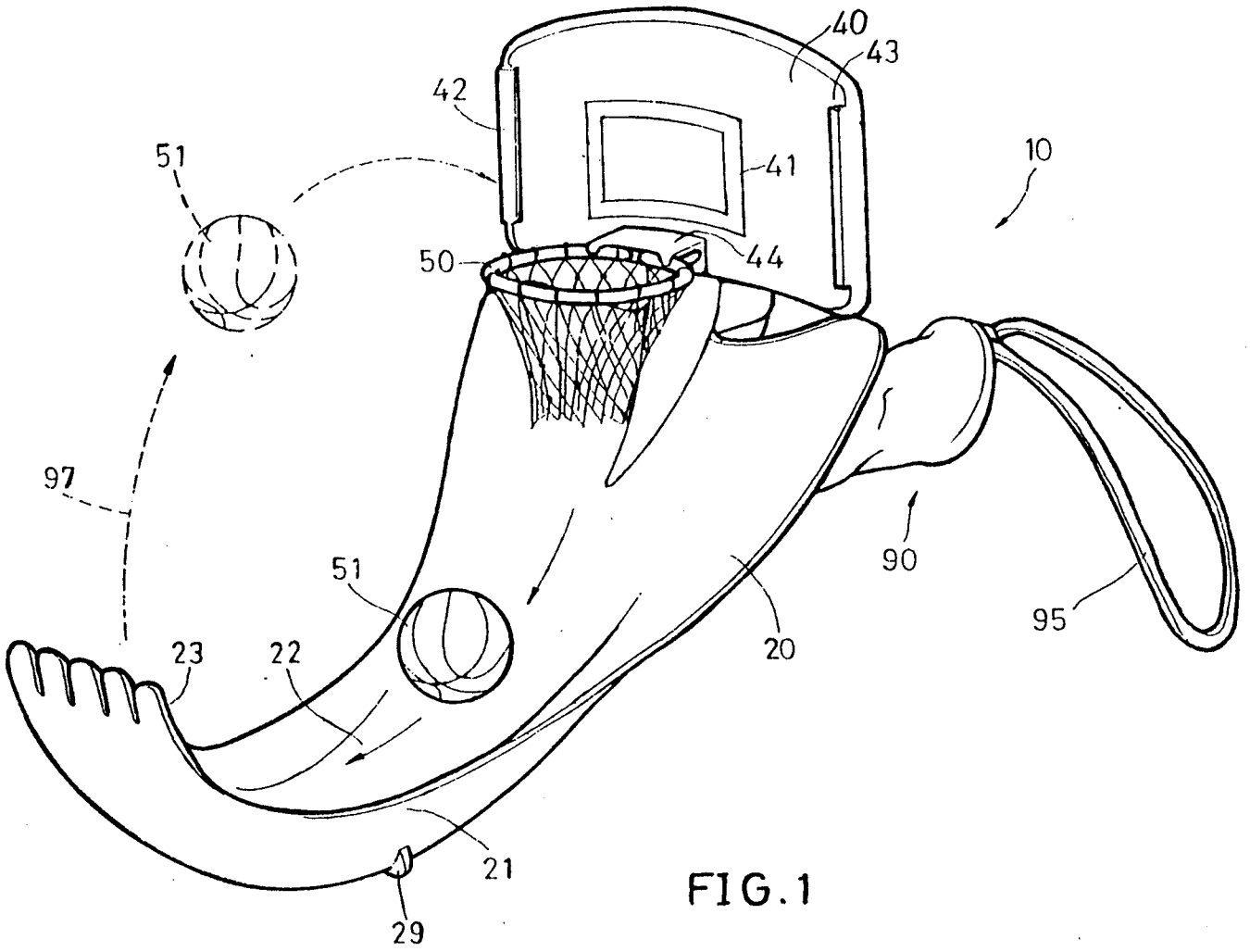
FIG. 1 is a three-dimensional perspective of the invention.

Please refer to FIGS. 1 through 4. The present invention 10 includes a curvy body 20, a fixing member 30, a backboard 40, a first catching means 50, and a handle 90.

The curvy body is arcuate in shape and has two upward extending side walls 21, a rolling path 22 formed between the two side walls 21, an upward extending curvy front portion 23, a recess 24 formed at rear end of the curvy body 20, two first through holes 25 provided at two side walls of the recess 24, and a dent 26 formed on top edge of the recess 24.

The fixing member 30 has a downward protrudent portion 31 having a shape corresponding to that of the recess 24 so that it is fittedly received by the recess 24, a head portion 34 forming the top of the protrudent portion 31 and having a downward extending tooth 35 generally parallel to the protrudent portion 31, and a square plate portion 37 provided in front of the head portion 34 with two threaded holes 38 forward at proper positions.

When assembling the curvy body 20 and the fixing member 30, engage the fixing member 30 with the recess 24 and fasten them together with a screw 32 and a nut 33 by threading the screw 32 through the first through holes 25 and a second through hole 36 provided on the protrudent portion 31 at a position corresponding to the through holes 25. The tooth 35 shall fall into the dent 26 when the fixing member 30 is inset into the recess 24 and thereby, facilitates the positioning of the fixing member 30 in the recess 24.

The backboard 40 has a square back recess 41 having a size the same as that of the square plate portion 37 and at a position corresponding to the square plate portion 37, two forwardly extending L-shaped members 42 separately provided at two sides of the backboard 40, and a bracket 44 centered at front bottom edge of the background 40. The square back recess 41 just receives the square plate portion 37 and, a screw 32 is used to thread through the back recess 41 and screw into one of the threaded holes 38 so as to tightly fasten the backboard 40 to the fixing member 30. The bracket 44 has two forwardly protruded portions 46 separately at its two front left and front right corners and is tightly fasten to the backboard 40 by threading screws 32'' through the backboard 40 and into another through hole 38 on square plate portion 37. Pictures or cards 52 with patterns showing different ball games may be inserted into grooves 43 separately formed between the L-shaped members 42 and the backboard 40. Each of the pictures or cards 52 has an indent 53 at a position corresponding to the bracket 44.

Figure 2:
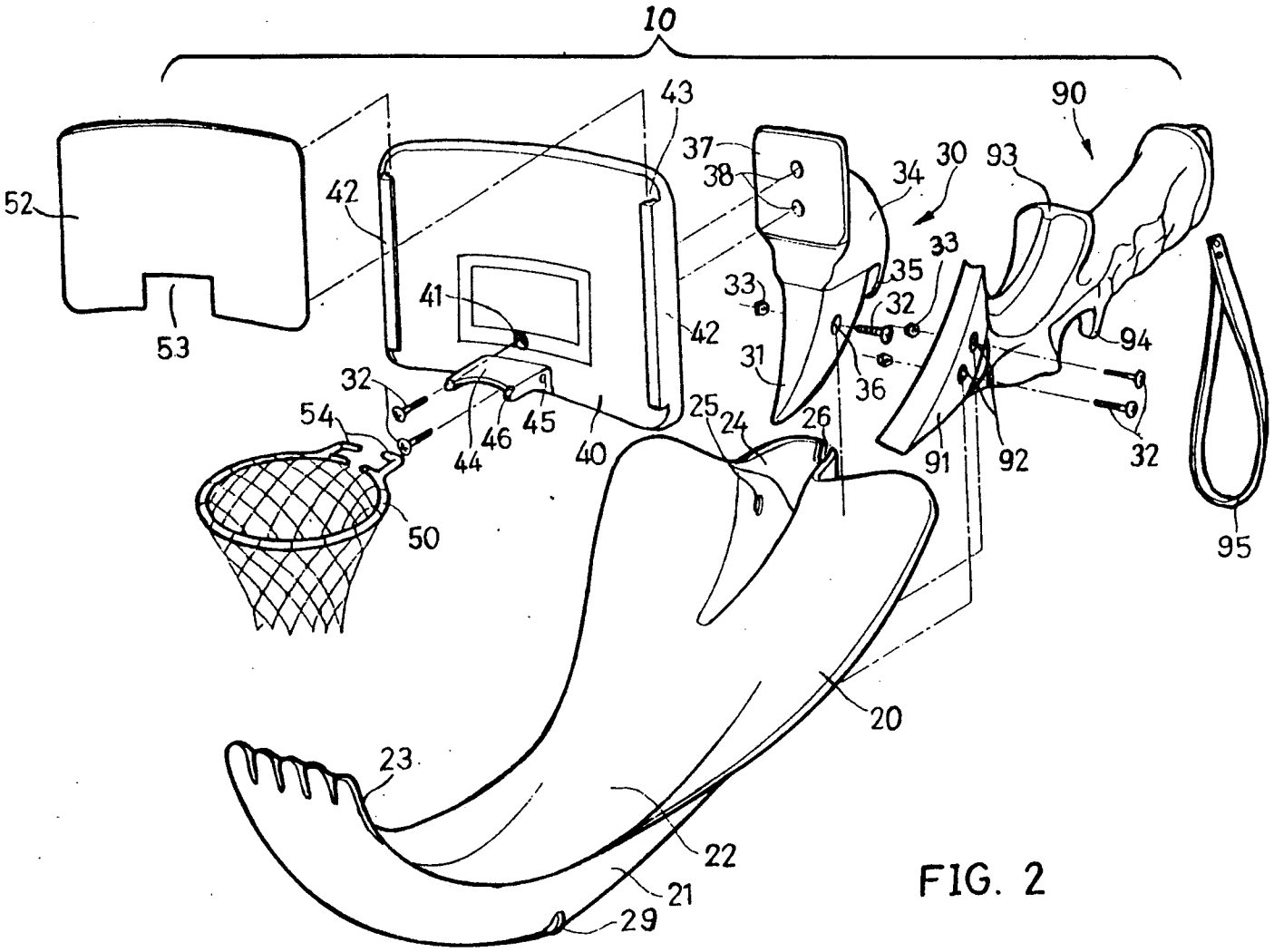
FIG. 2 is an analytical three-dimensional perspective of the present invention.

A hole 45 is formed at each side of the bracket 44 allowing the catching means, the first catching means 50 in the case shown in FIG. 2, to firmly hang onto the bracket 44 in such a manner that two pins 54 provided on the catching means 50 just separately insert into the two holes 45 with a ring of the catching means 50 pushing against lower part of the protruded portion 46.

Figure 6:
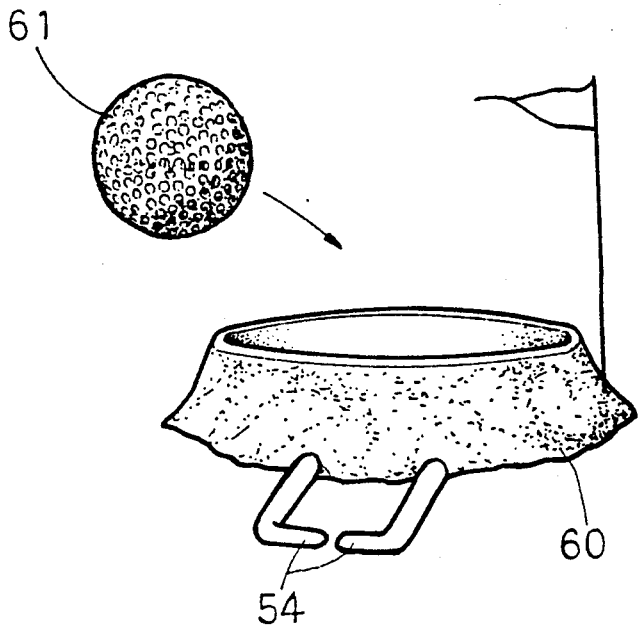
FIG. 6 is a second embodiment of the present invention in which the catching means and the ball are respectively designed to look like a hole and a ball used in a golf course.
Figure 5:
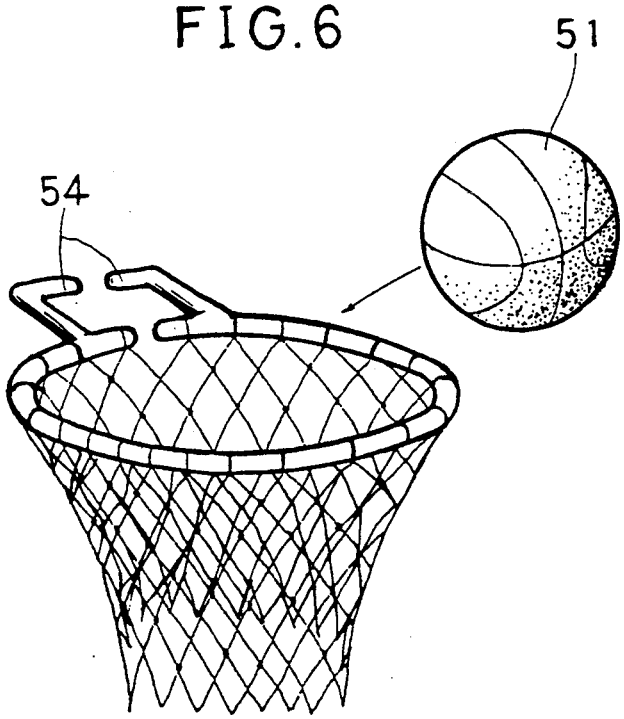
FIG. 5 is a first embodiment of the present invention in which the catching means and ball are respectively designed to look like a basket and a basketball used in a basketball court.
Figure 7:
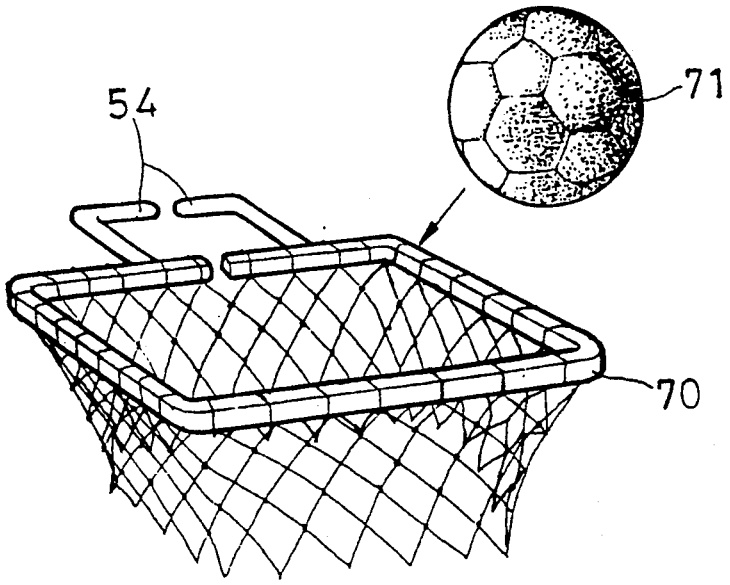
FIG. 7 is a third embodiment of the present invention in which the catching means and ball are respectively designed to look like a goal net and a ball used in a handball field.
Figure 8:
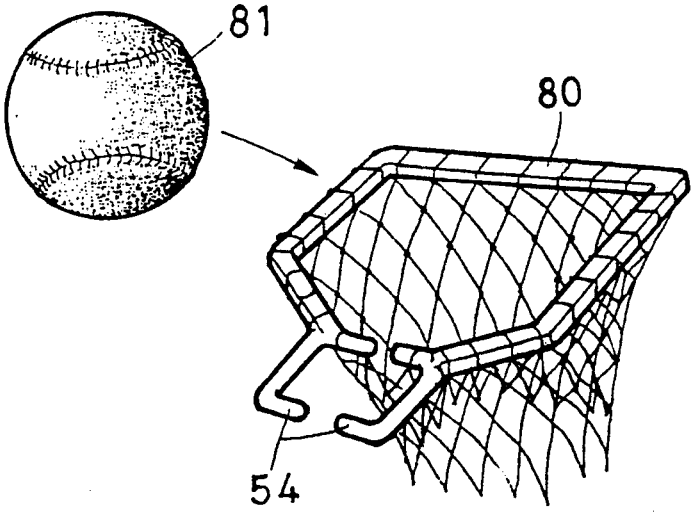
FIG. 8 is a fourth embodiment of the present invention in which the catching means and the ball are respectively designed to look like a home plate and a baseball used in a baseball field.

The catching means is changeable in design to match with any of desired ball game. For example, a basketball-ring-like catching means 50 is shown in FIG. 5 for users to play a mini basketball 51, a golf-hole-like catching means 60 is shown in FIG. 6 for users to play a golf ball 61, a goal-net-like catching means 71 is shown in FIG. 7 for users to play a handball 71, and a home-plate-like catching means 80 is shown in FIG. 8 for users to play a baseball 81. Each kind of catching means has two pins for inserting into the bracket 44.

Two arcuated fastening members 27 having proper numbers of threaded holes 28 are provided downside rear end of curvy body 20 allowing a mounting portion 91 of the handle 90 having holes 92 corresponding to the threaded holes 28 to be fixedly mounted therebetween. Screws 32, together with nuts 33, are used to thread through these holes 28, 92 and thereby, fix the handle 90 onto the fastening members 27, and the curvy body 20, accordingly.

Figure 3:
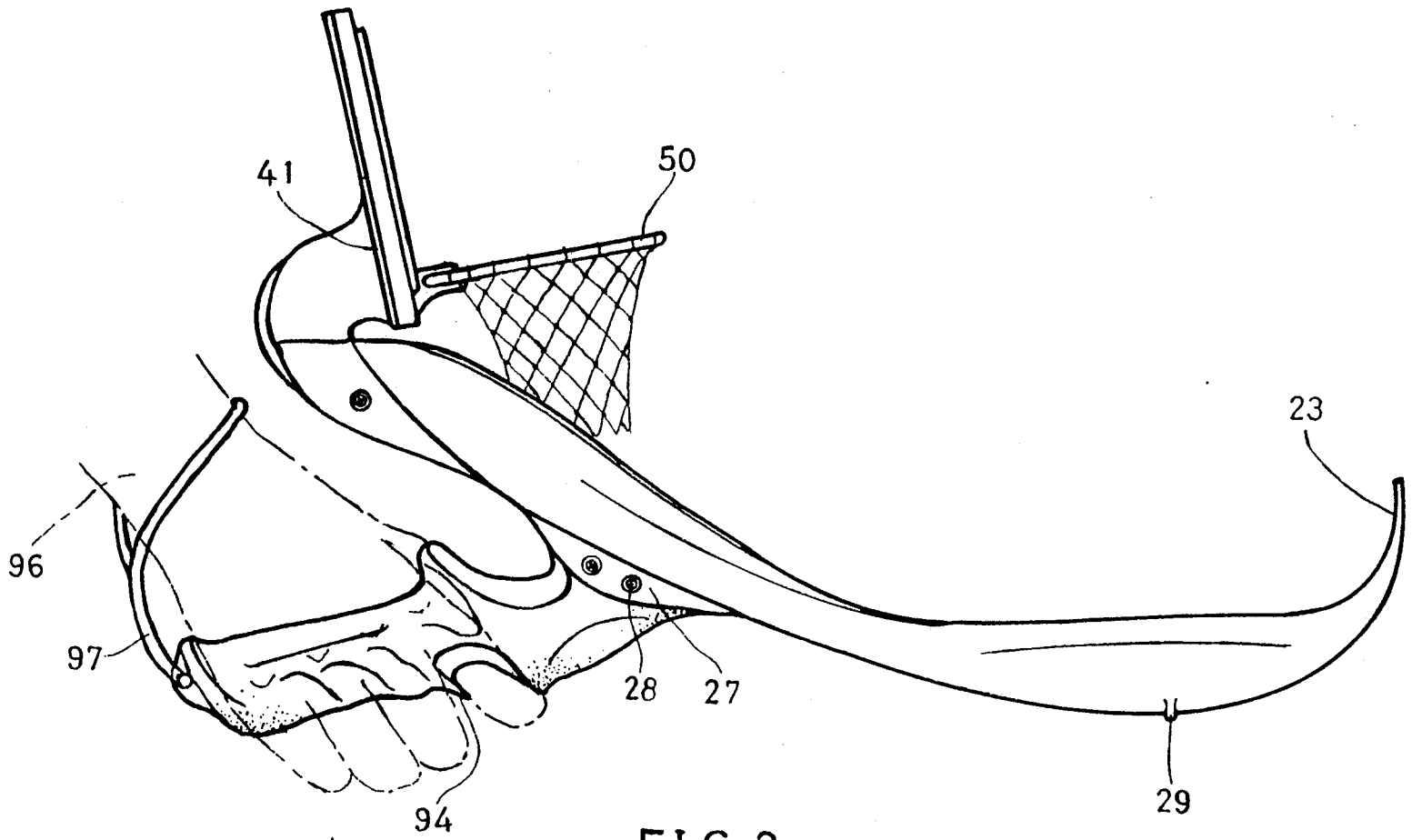
FIG. 3 is a side view of the present invention.
Figure 4:
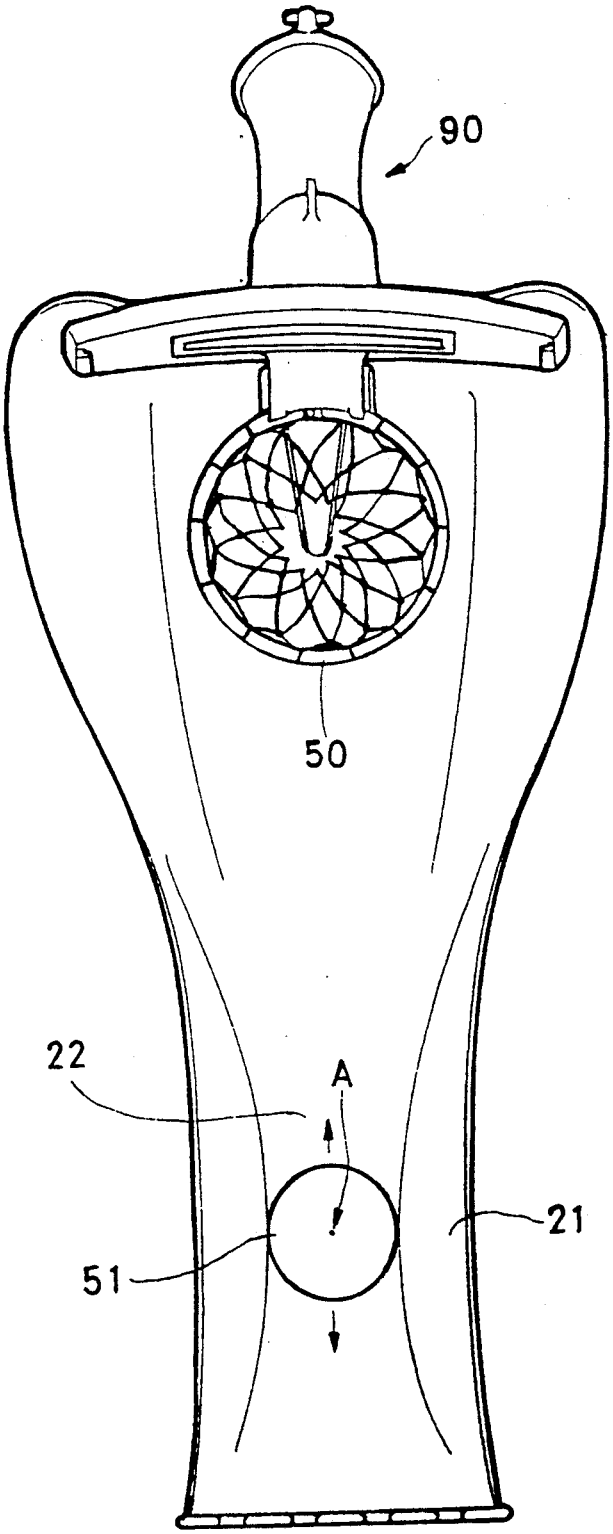
FIG. 4 is a top view of the present invention.

The handle 90 has stopper portions 93, 94 formed on top and bottom of the handle 90 at proper positions, respectively, and a loop 95 provided at rear end of the handle 90. As shown in FIGS. 3 and 4, a user's hand 96 passing through the loop 95 may grip the handle 90 with index finger 97 locating in front of the stopper portion 94 and the other three fingers at back of the stopper portion 94. A ball 51 or the like is positioned on the curvy body 20 at its lowest point A and is rolled back and forth with adequate force for several times before being thrown upward to the air as shown in FIG. 1. With adequate force applied to it, the ball 51 or the like shall move along the curvy front portion 23 of the curvy body 20 and fly into the air along a parabolic path 98 before falling into or outside the catching means 50 or the like.

Furthermore, a locating member 29 may be provided at proper position near bottom front of the curvy body 20. With this locating member 29, the curvy body 20 may be erected so that it stands in perpendicularly to any flat top and allows a user at a distance from the curvy body 20 to throw a ball aimed at the catching means 50 and the like. Such activity permits people in the office to relax their work tension and stress.

What is claimed is:

1. A ball-delivering-and-catching device comprising:

a curvy body in arcuate shape having two upward extending side walls, a rolling path formed between said two side walls, an upward curvy front portion, a recess at rear end and having a dent on top of its back edge, two arcuate fastening members provided dowside rear end of said curvy body, and a locating member at proper position near bottom front of said curvy body;

a fixing member having a head portion, a downward protrudent portion extending from bottom of said head portion;

said head portion having a square plate portion at its top front with a plurality of threaded holes formed thereon, and a downward extending bottom tooth in parallel with said protrudent portion and being capable of fittedly engaging with said dent at rear end of said recess;

said protrudent portion having a shape just corresponding to said recess on said curvy body and being capable of engaging with said recess with screws;

a backboard having a forward extended L-shaped flange at each vertical side to form a groove between said backboard and said L-shaped flange; said backboard being fixedly fastened to said square plate portion by screwing screws through said threaded holes on said square plate portion;

a plurality of pictures or cards with different ball game patterns and in size suitable for inserting into between said two grooves of said backboard, each of said pictures or cards having a generally centered bottom indent;

a bracket fixed to bottom edge of said backboard at a position corresponding to said bottom indent on said pictures or cards when they are inserted into between said grooves of said backboard; said bracket having a hole formed on each side wall and a forward protrudent portion formed at each front corner;

a catching means having two pins in such a position and manner that allows them to insert into said holes on said bracket; and a handle having a mounting portion at front end for fixing to and between said two arcuate fastening members downside said curvy body with screws; and two stopper portions separately provided at top and bottom of said handle at proper positions for easy grip.

2. A ball-delivering-and-catching device as claimed in claim 1, wherein said catching means may be designed to have different forms reflecting different ball games while different but corresponding balls may be used to give more funs.

3. A ball-delivering-and-catching device as claimed in claim 1, wherein said handle has loop attached to its rear end allowing a user's handle to pass through, thereby secures the grip of said handle by the user.

* * * * *